United States Patent [19]

Yamada

[11] 4,334,704

[45] Jun. 15, 1982

[54] AUTOMOBILE DOOR LOCKING MECHANISM

[75] Inventor: Shinjiro Yamada, Tokyo, Japan

[73] Assignee: Mitsui Kinzoku Kogyo Kabushiki Kaisha, Tokyo, Japan

[21] Appl. No.: 135,902

[22] Filed: Mar. 31, 1980

[51] Int. Cl.[3] ..... E05C 3/26

[52] U.S. Cl. ..... 292/216

[58] Field of Search ..... 292/216, 280, DIG. 27, 292/DIG. 65

[56] References Cited

U.S. PATENT DOCUMENTS

| | | | |
|---|---|---|---|
| 3,123,390 | 3/1964 | Savdor et al. | 292/DIG. 27 X |
| 3,128,113 | 4/1964 | Lee | 292/DIG. 27 X |
| 3,140,888 | 7/1964 | Di Salvo | 292/DIG. 27 X |
| 3,697,105 | 10/1972 | Marx | 292/DIG. 27 X |
| 3,923,329 | 12/1975 | Torii et al. | 292/DIG. 27 X |

*Primary Examiner*—Richard E. Moore

*Attorney, Agent, or Firm*—Browdy and Neimark

[57] ABSTRACT

An automobile door locking mechanism incorporated with a child lock device which is connected to an actuator lever of the mechanism through idle means and operable to keep the locking mechanism in a locking condition even when a locking knob is released and a door handle or button is manipulated and which allows the door or button to move idly.

5 Claims, 10 Drawing Figures

AUTOMOBILE DOOR LOCKING MECHANISM

This invention relates to an automobile door locking mechanisms, and more particularly a child lock device thereof. There is provided to an interior part of an automobile door a locking knob which does not allow the door to be opened by the manipulation of an interior door handle when it is pressed to a locking position.

However, children play with the locking knob, resulting in releasing its locking, and in addition they sometimes pull the interior door handle. This means that the locking knob is not absolutely safe for securing the locking of door, when children are involved. In order to prevent the above, a device which is commonly called as a child lock device is known. When the automobile door locking mechanisms is incorporated with such child lock device, they can't be unlocked even when the locking knob is played by children and released.

This invention employs structures common to conventional child locking device, while it is characterized in the provision of connector means with an idle device which are located between the interior door handle and an open or actuator plate.

To the automobile body there is provided an engaging part which is called as a striker, while to the door there is provided a latch which meshes and engages with the said striker. Said latch rotates when the door is closed and the striker engages with the latch. As the latch which has engaged with the striker and has rotated is kept at its position by a ratchet, the door is kept locked. When a button fitted to the door handle or handle itself is actuated, the open or actuator lever is rotated to release the engagement of ratchet with the latch and to allow the door open. However, when the locking mechanism is locked by the operation of a key or locking knob, the door can't be opened by pressing the button or the door handle. This is because that when the button or handle is operated, the open lever can move still, whereas the ratchet is not released from the latch on account of the disengagement of the open lever from the ratchet. This mechanism, that is, making the ratchet immovable even when the open lever is operated is called as idle mechanism in this specification. This idle mechanism is effective not to break the locking mechanisms. If the locking mechanism is made with such constructions that when it is locked, its handle or button remain unmoved, excessive force which is given to the button or handle by a passager against them would break the locking mechanism.

This invention is, therefore, to provide an automobile door locking mechanisms incorporated with a child lock device which is connected to an open lever of the locking mechanism through an idle means and is operable to keep the locking mechanism in a locking condition even when a locking knob is released and a door handle or button is manipulated and which allows the door handle or button to move idly.

This invention is characterized also in that the child lock device incorporated thereto has lesser number of parts than conventional devices of the kind.

Constructions of the locking apparatus in accordance with this invention are explained in the following with reference to the accompanying drawing.

Figure 2:
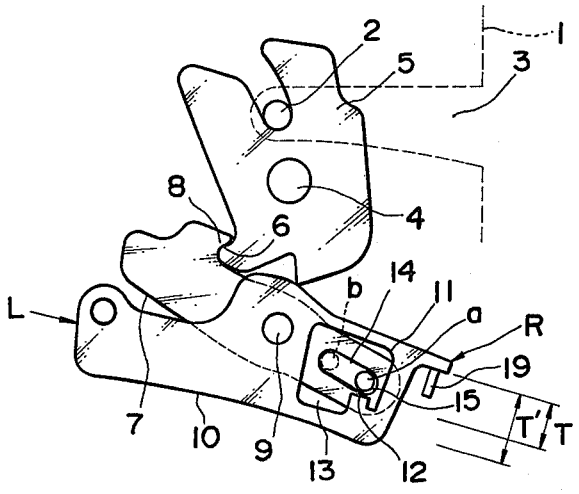
FIG. 2 is a plan view of a latch, ratchet and actuator plate.

A metallic base plate 1 which is fixed to an automobile door and by means of which various component parts of the locking apparatus are assembled at their places, has a slot opening 3. This opening slidably engages with a striker 2 which is fixedly fitted to the automobile body. A latch 5 which is pivotally fitted to the base plate 1 by an axis 4 faces, at its part, to the slot opening, as best shown in FIG. 2. Said latch has at its circumferential part a shoulder 6 which is engageable with a pawl 8 of a ratchet 7 so at to prevent the disengagement of the latch from the striker. Said ratchet 7 is pivotally fitted 20 to the base plate 1 by an axis 9 which fixes also an actuator plate 10 pivotally to the base plate. This actuator plate has an opening 11. To this opening and at its part which is remote from the axis 9, there is provided an abutment 12 so as to make said opening in the rotary direction of the plate 10 have a marrow width T, and at its part adjacent to the axis 9, an idle opening 13. The ratchet 7 and actuator plate 10 are pivoted to the common axis 9 so as to be one above another, and the part of ratchet which faces to the opening 11, has a slot 14 which extends in a radial direction of the axis 9. A connecting rod 15 which projects at a right angle to the slot 14 and opening 11, is insertedly and movably fitted to them. Said rod is changeable of its location to positions a and b (FIG. 2), when a locking lever 16 is actuated.

Figure 3:
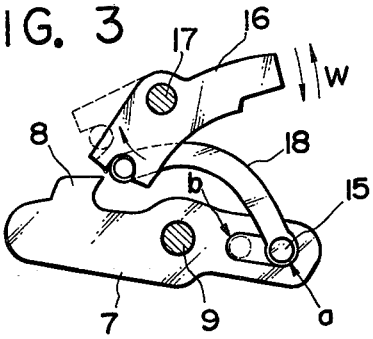
FIG. 3 is a plan view of a locking lever and the ratchet.

The operative relation of the connecting rod 15 with the locking lever 16 is illustrated in FIG. 3 in which the locking lever 16 is pivotally fitted to the base plate by an axis 17 and rotatable to directions W to assume a location of solid lines or another location of dotted lines, when actuated by pressing or pulling a locking knob which is provided to the inside of automobile door or by operating a key. A rod 18 which engages at its end the locking lever 16 and which is fitted at its another end to the connecting rod 15, connects them.

Figure 1:
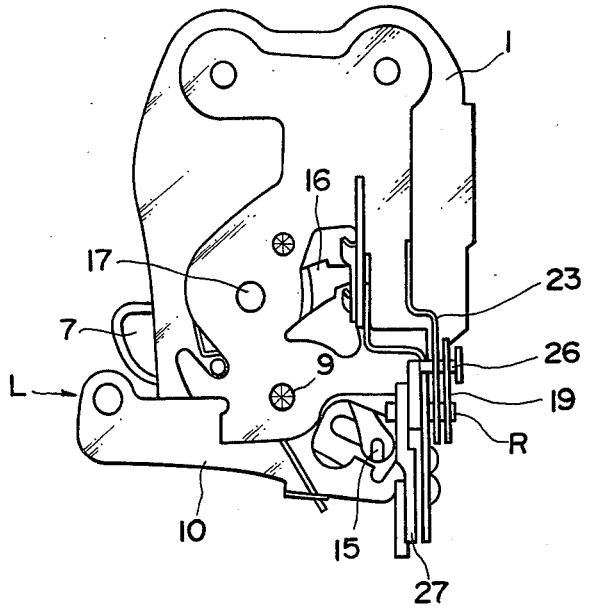
FIG. 1 is a front view of the automobile door locking mechanism of this invention.
Figure 4A:
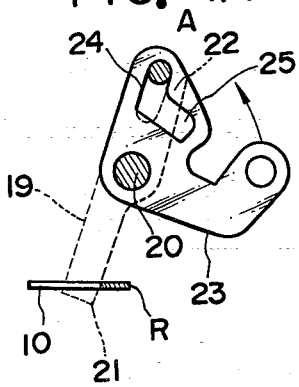
FIG. 4A is a side view of a connecting lever.
Figure 5:
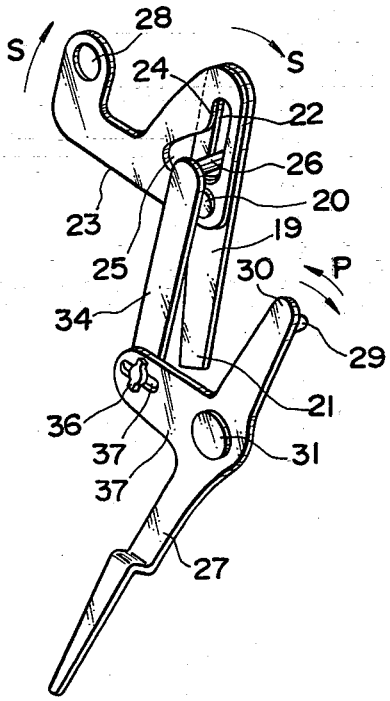
FIG. 5 is a perspective view of a child lock change lever.
Figure 4B:
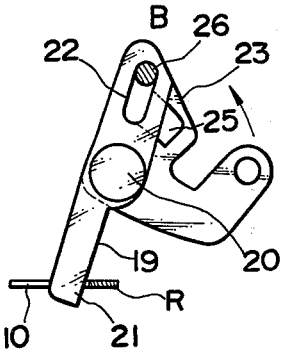
FIG. 4B is a side view of the said connecting lever and a rotary lever.

With reference to FIGS. 1 and 2, the actuator plate 10 is connected at its left end L to an exterior door handle by suitable connecting means, while its right end R engages a rotary lever 19 which is operative by an interior door handle. Constructions of the rotary lever 19 are illustrated in detail in FIGS. 4A and 4B. The central portion of rotary lever 19 is pivotally fitted to the base plate 10 by an axis 20, and its lower end 21 engages with the right end R of the actuator plate 10 and its upper part has a slot 22 which extends radially to the axis 20. A lever 23 is also pivotally fitted to the axis 20 so as to be one over another. To a part of the lever 23 which lies over the rotary lever 19, there is provided an elongated slot 24 which is correspondent to the slot 23. A half portion of said slot 24 which locates adjacent to the axis 20 projects laterally and froms an idle slot 25. Numeral 26 indicates a connecting pin which projects at a right angle from the top end of an arm 34 and which engages both the slots 22 and 24. The lower end of the arm 34 is connected to a child lock change lever 27 (FIG. 5). When the said lever 27 is operated by a driver and rotated to the direction P, the pin 26 slidingly moves between the upper ends and lower ends of the slots 22, 24.

The interior door handle is connected, through rod means, not to the rotary lever 19, but to an opening 28 of the lever 23.

Figure 6:
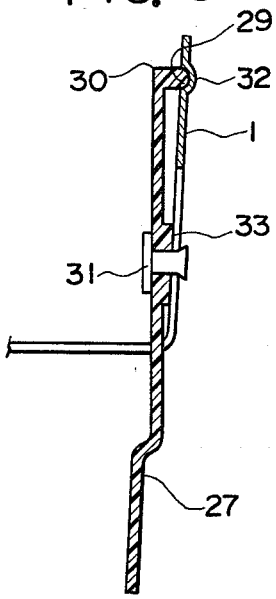
FIG. 6 is a sectional view of said change lever.
Figure 7:
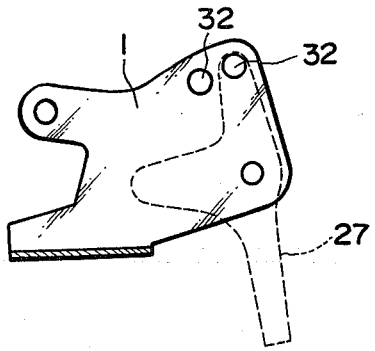
FIG. 7 is a view showing the fitting of the change lever to a base plate.
Figure 8:
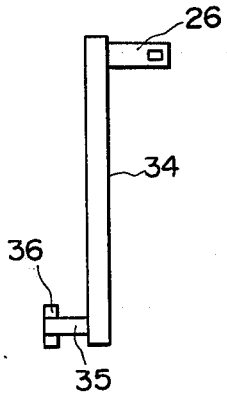
FIG. 8 is a side view of an arm of the change lever.
Figure 9:
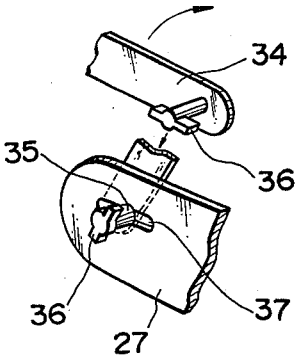
FIG. 9 is a view showing a way how the arm and the change lever are connected.

In FIG. 6, fixtures of the child lock change lever 27 are shown. Said lever 27 is made of plastics having slight resiliency, and to the side of its rotary end 30, there is formed a projection 29 which faces to the metallic base plate. The projection 29 is integral with the lever 27, and according, is also of plastics. The lever 27 is pivotally fitted to the base plate 1 by a pin 31 which passes through a boss 33. The projection 29 projects from the lever 27 slightly larger than the boss 33. This makes the rotary end 30 to flex resiliently against recesses 32. Said recesses are two as shown in FIG. 7, and are located with a distance therebetween. In FIG. 8, there are shown the connecting pin 26, the arm 34, and a projection 35 which engages with the child lock change lever 27. They are all integral and made of plastics. To the both sides of head of the projection 35, there are formed extension 36, 36 which extend in a longitudinal direction of the arm 34. And, to another rotary piece 37, there is formed a slot 37'. With these structures, when the arm 34 and the child lock change lever 27 are brought near, the extensions 36 are insertedly fitted to the slot 37', and the arm 34 is rotated to the direction S, they are firmly engaged each other and would not be released.

This locking apparatus operates as follow:

When a child accompanied by a driver rides in a vehicle and the door is closed, the latch 5 of lock device comes to the engagement with the striker 2. As shown in FIG. 2, the latch 5 rotates about the axis 4, and the pawl 8 of ratchet 7 engages with the shoulder 6 of latch 5 for preventing the reversal rotation of latch 5. On the condition shown by FIG. 2, when the actuator plate 10 is rotated counter-clockwise by the operation of exterior or interior door handle, the abutment 12 presses the connecting rod 15 upwardly, resulting in the pressing of inner wall of the slot 14 and the counter-clockwise rotation of ratchet 7, whereby the pawl 8 is released from the shoulder 6 and the door opens. However, when a seal or locking knob provided interiorly to the door is pressed, the locking lever 16 changes its location from the solid lined position to the dotted lined position as illustrated in FIG. 3, whereby the rod 18 is moved, resulting in changing the location of connecting rod 15 from the position a to the position b. Under this condition, the counter-clockwise rotation of actuator plate 10 by the operation of a door handle does not produce any movement of the connecting rod 15 and keep it idle, because said rod is in the idle opening 13. Accordingly ratchet 7 does not move and keeps the device in the locking condition.

Under this condition where the connecting rod in at the position b, when the child lock change lever 27 is rotated counter-clockwise as shown in FIG. 5, the arm 34 moves downwardly, and the connecting pin which is provided to the upper end of said arm 34 moves also downwardly so as to be at a position within the idle slot 25 of the elongated slot 24 of the lever 23, whereby even when the lever 23 is rotated to the direction S by the operation of interior door handle, it does not engage with the connecting rod 15 and the rotary lever 19 does not move. This results that even if a child pulls the seal knob and operates the interior door handle, the door shall never be open (or the door is child locked). In this invention, as the child lock change lever 27 is made of plastics which have slight resiliency, and as the rotary end 30 of lever 27 engages at its projection 29 with the base plate 1 flexedly by said projection, the driver can operate said lever with certain feeling. In addition, as the lever 27 is made of plastics and fitted to the base plate flexedly, the employment of spring washers is eliminated.

As stated above, the child locking mechanisms of this invention employ the lever 23 provided with the idle slot. This enables that even when the interior door handle is pulled and when the door is child locked, the handle keeps its actuation mechanisms idle without giving unnatural force to them. Also as stated above, the lever 27 of child locking mechanisms is made of plastics, as a whole, resulting in the elimination of spring washers and in making it easy to make. As the connecting pin 26, arm 34, projection 35 and extensions 36, 36 are integrally made of plastics, their manufacture is easy. In addition, as the projection 32 of the plastic lever 27 resiliently and pressedly engages with either one of recesses 32, and accordingly it can assume its selected position by itself, the provision of over-centering spring to the base plate is also eliminated.

What is claimed is:

1. An automobile door locking mechanism comprising a latch rotatable with the engagement with a striker, a ratchet for preventing the rotation of the latch in the direction for releasing its engagement with the striker, an actuator plate for releasing the engagement of rachet with latch, connecting means for effecting and releasing the engagement of the actuator plate with the rachet, and a rotary lever operable to actuate the actuator plate with the operation of an interior door handle, in which to a shaft which pivotally fixes the rotary lever, another lever is pivotally fitted, either one of said levers being formed with a slot opening which extends radially to the shaft and the other being formed with a slot opening having an idle opening which extends about the shaft, and connector means having a part which passes through the slot openings at a right angle to the rotary plane of the levers, said connector means being connected to a child lock change lever so as to slidingly change its location within the slot openings and said another lever being connected to the interior door handle.

2. Locking mechanism as claimed in claim 1, in which all parts of the child lock change lever which is pivotally fitted to a base plate is made of plastics, the lever being provided at a part remote from its axis with a projection extending towards the base plate and being flexed on account of the resilient and strong abutment of said projection.

3. Locking mechanism as claimed in claim 1, in which the connector means comprises an arm, a projection and extensions which are integrally made of plastics.

4. Locking mechanism as claimed in claim 1, in which the child lock change lever has a boss to which the axis is fitted, said boss being projected lesser than the projection.

5. Locking mechanism as claimed in any one of claims 1, 3 and 4, in which a rotary piece which projects laterally from the child lock change lever is connected to the lower part of arm substantially at a right angle to the longitudinal direction of the said arm by the extensions of the arm which are passed through said slot opening of the rotary piece and make a right angle with said slot opening.

* * * * *